United States Patent [19]

Stob

[11] Patent Number: 4,991,070

[45] Date of Patent: Feb. 5, 1991

[54] SLEEVE FOR A LIGHT ELEMENT

[75] Inventor: Henry R. Stob, Grand Rapids, Mich.

[73] Assignee: Herman Miller, Inc., Zeeland, Mich.

[21] Appl. No.: 379,330

[22] Filed: Jul. 12, 1989

[51] Int. Cl.[5] ..... F21Y 13/04

[52] U.S. Cl. ..... 362/223; 362/282; 362/283; 362/329

[58] Field of Search ..... 362/217, 223, 266, 255, 362/277, 319, 320, 329, 376, 348, 268, 282, 283

[56] References Cited

U.S. PATENT DOCUMENTS

| | | | |
|---|---|---|---|
| 1,590,130 | 6/1926 | Sturgeon, Jr. | 362/348 |
| 2,337,745 | 12/1943 | Garstang | 362/260 |
| 2,347,671 | 5/1944 | Dircksen | 362/260 |
| 2,366,216 | 1/1945 | Roberts | 362/2 |
| 3,115,309 | 12/1963 | Spencer et al. | 362/217 |
| 3,371,201 | 2/1968 | Yonkers | 362/223 |
| 3,558,873 | 1/1971 | Smith | 362/223 |
| 3,673,401 | 6/1972 | DuPont | 362/377 |
| 3,805,053 | 4/1974 | Julinot | 362/223 |
| 4,112,485 | 9/1978 | Sutter | 362/369 |
| 4,186,431 | 1/1980 | Engel et al. | 362/223 |
| 4,262,327 | 4/1981 | Kovacik et al. | 362/223 |
| 4,312,028 | 1/1982 | Hamacher | 362/369 |
| 4,318,163 | 3/1982 | Bryan | 362/359 |
| 4,337,503 | 1/1982 | Turner | 362/72 |
| 4,373,178 | 2/1983 | Gulliksen | 362/280 |
| 4,418,378 | 11/1983 | Johnson | 362/223 |
| 4,432,044 | 2/1984 | Lautzenheiser | 362/223 |
| 4,484,254 | 11/1984 | Puckett et al. | 362/375 |
| 4,642,741 | 2/1987 | Cohn | 362/377 |
| 4,739,454 | 4/1988 | Federgreen | 362/133 |
| 4,858,088 | 8/1989 | Agabekov | 362/223 |

FOREIGN PATENT DOCUMENTS

| | | | |
|---|---|---|---|
| 52-51781 | 4/1977 | Japan | 362/260 |

*Primary Examiner*—Allen M. Ostrager
*Assistant Examiner*—Richard R. Cole
*Attorney, Agent, or Firm*—Varnum, Riddering, Schmidt & Howlett

[57] ABSTRACT

A protective, reflective, light diffusing sleeve is adapted to mount on a light element to protect the element and intercept light emitted therefrom. The sleeve comprises a tube adapted to telescopically receive the element and a reflecting member carried by the tube for reflecting light emitted from the element. The tube is adapted to mount on the element for free rotation relative thereto to move the reflecting member about the element to control the direction of reflective light. The sleeve further comprises an element carried by the tube opposite the reflecting member for diffusing light reflected therefrom. The diffusing element comprises a field of prisms formed on and extending along a longitudinally extending portion of the tube.

19 Claims, 3 Drawing Sheets

SLEEVE FOR A LIGHT ELEMENT

BACKGROUND OF THE INVENTION

1. Field of the Invention

The invention relates to a protective, reflective, light-diffusing sleeve adapted to be used in connection with a fluorescent light fixture and more particularly a sleeve adapted to telescopically receive a conventional fluorescent light bulb or element and freely rotate about the element to maximize a user's ability to direct light onto desired surfaces.

2. Prior Art

Three problems are associated with the use of conventional fluorescent light fixtures. First, the long, narrow geometry of conventional fluorescent elements increases their susceptibility to breakage. This problem may be solved by using a protective housing to cover the bulb; however, the housings are often bulky and may not easily fit within confined areas.

An alternate solution is to use a clear tube of extruded plastic which telescopically receives the fluorescent element. The tube protects the element from breakage and, if breakage should occur, the tube retains glass fragments. Protective tubes are required in restaurant industry settings, where broken glass could contaminate food, such as in overhead illumination of salad bars and steam tables U.S. Pat. No. 4,262,327 to Kovacik et al., issued Apr. 4, 1981, discloses a fluorescent light fixture in which a plastic, tubular, light transmitting envelope is concentrically disposed about a standard fluorescent bulb or element.

The second problem associated with fluorescent lighting use is eyestrain. This is especially troublesome when the fixture provides direct illumination of work surfaces in office environments. Light diffusing lenses have been used to reduce eyestrain.

The third problem associated with using fluorescent lighting is that the cylindrical cross-sectional sectional geometry of conventional fluorescent elements causes light to be emitted in a 360° array. This arrangement is inefficient because much of the emitted light is not directed onto the desired surface. A partial solution to the problem is the use of reflective surfaces to direct the light. For example, U.S. Pat. to Kovacik et al., teaches the use of a reflective material, such as a strip of foil covered paper, received within the tubular envelope covering a portion of its circumference to form a reflector. U.S. Pat. to Spencer et al. No. 3,115,309, issued Dec. 24, 1963, discloses a fluorescent light bulb having a reflective coating thereon to increase brightness.

However, such reflective substrates are only a partial solution. It is desirable for the user to be able to freely control the directionality of the light, thus allowing the user to direct more or less light into particular objects or portions of the work surface. The illumination required is dictated by the task in which the user is engaged.

Kovacik et al., nonrotatably mount their tubular element relative to the fluorescent bulb. U.S. Pat. No. 4,373,178 to Gullikesen, issued FIB. 8, 1983, discloses a tubular lens slidably and telescopically mounted in relation to an incandescent light source. Retracting or extending the lens respectively creates a spot or food configuration of light. Spencer et al., disclose that the brightness of their fluorescent element can be increased by forming a longitudinal gap in the conventional phosphor coating covering the tube. U.S. Pat. No. 4,337,503 to Turner, issued June 29, 1982, discloses a housing for a fluorescent element provided with a multiplicity of apertures from which light emanates.

However, the prior art does not disclose a protective sleeve, which telescopically receives a conventional fluorescent element and which has a light diffusing lens formed integral therewith and a reflective substrate. The prior art also does not teach an arrangement wherein the user has free control over the directionality of the light. The areas which can be illuminated are fixed once the lighting fixture is installed.

It has therefore been found desirable to provide a plastic sleeve for telescopically receiving a conventional fluorescent element and which is closed off at opposite ends by caps to protect the element against breakage and to capture glass fragments in the event thereof. It has also been found desirable to provide a lighting fixture with increased efficiency by positioning a reflective substrate, such as aluminum covered paper adjacent the sleeve. To reduce the eyestrain, it has been found desirable to form integral with the sleeve a diffusing lens. It is further desirable to provide the user of the fixture with free control over the directionality of the light by allowing for free rotation of the sleeve and reflective substrate relative to the fluorescent element. In addition, it has been found desirable to enable the user to vary the quality and color of the light directed onto a work surface by allowing for interchangeable reflective substrates or, alternatively, by using a reflective substrate of nonuniform light reflecting character. Finally, it has been desirable to provide a design which facilitates packaging and shipping by forming the sleeve with lateral edges which allow the sleeve to be packaged and shipped in a flat configuration.

SUMMARY OF THE INVENTION

According to the invention, a sleeve is adapted to be mounted on a light bulb or element to protect the element and intercept light emitted therefrom. The sleeve comprises a tube adapted to telescopically receive the element and means carried by the tube for reflecting light emitted from the element. The tube is freely rotatable relative to the element so that the reflecting means can be moved about the element to control the direction of reflected light.

The sleeve further comprises a means carried by the tube opposite the reflecting means for diffusing light reflected therefrom.

In one embodiment of the invention, the sleeve further comprises a second tube having a greater cross sectional area than that of and telescopically receiving the first-mentioned tube for rotation relative thereto. The second tube has means thereon for providing alternative light diffusing properties. In this manner, the tubes can be independently rotated relative to the element to adjust the direction of light emitted therefrom and the quality of light reflected from the reflecting means.

BRIEF DESCRIPTION OF THE DRAWINGS

Reference will now be made to the drawings in which.

DESCRIPTION OF THE PREFERRED EMBODIMENTS

Figure 1:
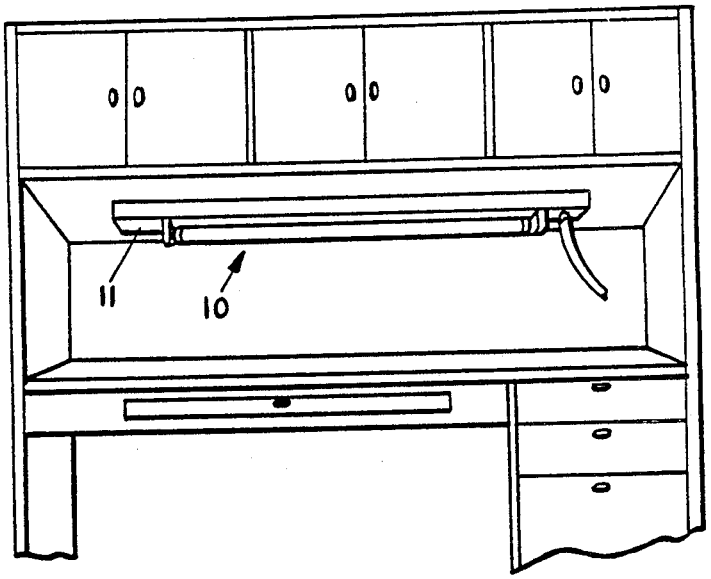
FIG. 1 is a front perspective view of a sleeve in accordance with the invention mounted on a fluorescent light fixture.

Referring to the drawings in detail, there is shown a protective, reflective, light diffusing sleeve 10 adapted to receive a conventional light bulb or element 26, such as a fluorescent element, mountable to a light fixture 11. The sleeve comprises a tube 12 for receiving the element 26, means for diffusing light emitted from the element, and means for reflecting emitted light onto desired working surfaces to increase efficiency of the element.

The tube 12 is preferably formed from extruded polycarbonate plastic, but it will be appreciated that any plastic which is resistant to heat and ultraviolet degradation and which has appropriate light transmitting characteristics is suitable.

Figure 2A:
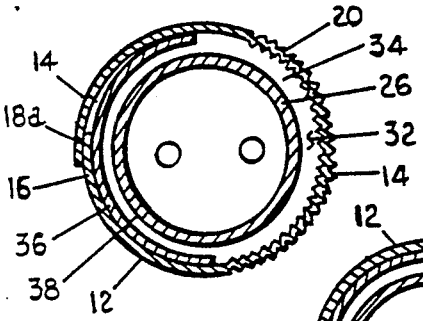
FIG. 2A is a cross sectional view of an alternative embodiment of the sleeve telescopically receiving the fluorescent light element.
Figure 2:
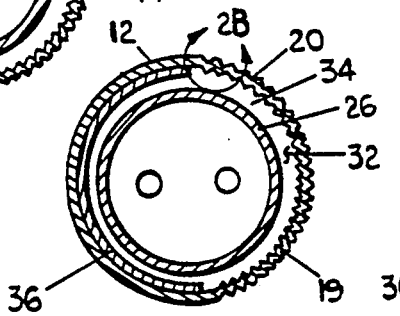
FIG. 2 is a cross sectional view of the sleeve telescopically receiving a fluorescent light element.
Figure 2B:
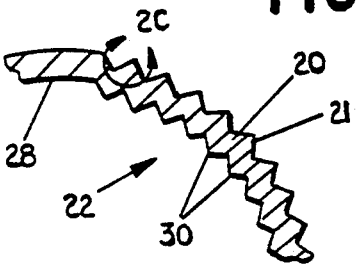
FIG. 2B is an enlarged fragmented view of a portion of FIG. 2.
Figure 2C:
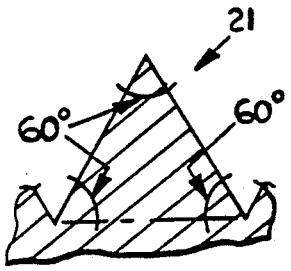
FIG. 2C is an enlarged fragmented view of a portion of FIG. 2B.
Figure 2D:
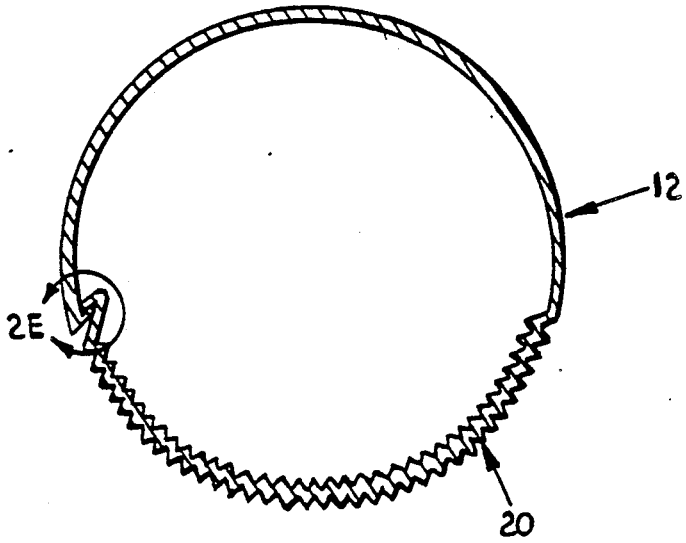
FIG. 2D is a cross-sectional view of an alternative embodiment of the sleeve telescopically receiving the fluorescent light element.
Figure 2E:
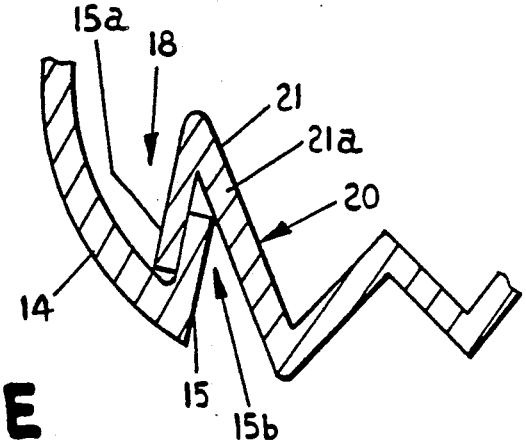
FIG. 2E is an enlarged fragmented view of a portion of FIG. 2D.

As illustrated in FIGS. 2D and 2E, the tube 12 is preferably formed with a longitudinal edge 14 which overlaps a lens 20 at a seam 18. The edge 14 is formed with an inwardly projecting locking flange 15 which engages a second flange **15*a* formed integral with a sawtooth configuration 21 of the lens 20. The locking flange 15 is received in a depression 15*b* between the second flange 15*a* and a tooth 21*a* of the sawtooth configuration 21. The flanges 15, 15*a* are sometimes hereinafter referred to as the "locking means." The configuration of FIGS. 2D and 2E is the preferred embodiment because it allows the tube 12**, in its unassembled form, to be packaged and shipped in a more or less flat configuration, which results in reduced freight costs.

Figure 5:
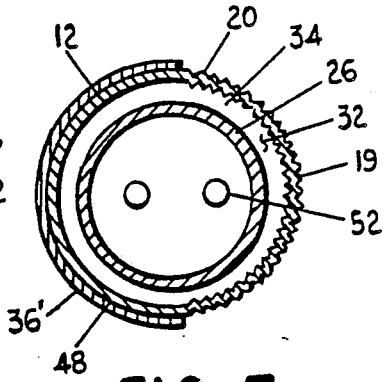
FIG. 5 is a cross sectional view of another embodiment of the sleeve telescopically receiving the fluorescent light element.

Alternatively, as best shown in FIG. 2A, the tube 12 may be formed without the flanges 15, **15*a*. In this embodiment, the longitudinal edge 14 overlaps a longitudinal edge 16 at a seam 18*a*. The edges 14, 16 are retained in their overlapped configuration at seam 18*a* by frictional forces of adhesion. In a third embodiment, as shown in FIGS. 2 and 5, the tube 12 may be formed as a continuous surface uninterrupted by either the seam 18 or 18*a***.

The tube 12 is preferably of circular geometry when viewed in cross-section. However, the tube 12 can be formed to appear oval or polygonal in cross-section.

The interior diameter of tube 12 is sized to receive a fluorescent element of conventional diameter, commonly referred to in the industry as a T-12 bulb. It will be recognized that the interior diameter of the tube 12 can be varied to accommodate fluorescent elements of other than conventional diameter, by using tubes of alternative cross-sectional shape or by using extrusion methods well known in the industry.

Placement of the fluorescent element 26 within hollow interior 32 of the tube 12 provides a void 34 between the same for placement of the reflecting means as will be discussed below in detail.

The light diffusing means comprises a lens 20 formed integral with a predetermined area of wall 19 of the tube 12 by an extrusion process well known in the art. As best shown in FIGS. 2B, 2C and 2E, the lens 20 has a sawtooth configuration 21, when viewed in cross-section, and comprises a field 22 of 60° prisms creating a plurality of angled surfaces to diffuse and reflect light. It will be recognized that the prisms of field 22 are not restricted to 60° . It will be further recognized that lens 20 may circumscribe a greater or lesser portion of the wall 19 than is illustrated in the figures.

The sawtooth configuration 21 interrupts a smooth interior surface 28 of the tube 12. Interior apexes 30 of the sawtooth configuration 21 project deeper into hollow interior 32 of the tube 12 relative to interior surface 28.

As shown in FIGS. 2, 2A, and 2D, the reflecting means comprises a reflective substrate 36 positioned within the void 34 in close relationship to the interior surface 28 of the tube 12 and exterior surface 38 of the element 26. The reflective substrate 36 preferably comprises a sheet of aluminum covered paper of overall rectangular geometry, an example of which is presently available from the 3M Company. However, foil or metal sheets having appropriate reflective characteristics can also be used. Alternatively, the interior surface 28 may be painted to provide a reflective surface.

The reflective substrate 36 increases the efficiency of the element 26 by increasing its illuminating capacity.

Because of its rectangular geometry, the substrate 36 tends to assume a planar configuration and therefore clings to the interior surface 28 of tube 12. It will be recognized that the size of the substrate 36 can be varied to circumscribe a greater or lesser portion of the element 26.

Figure 3:
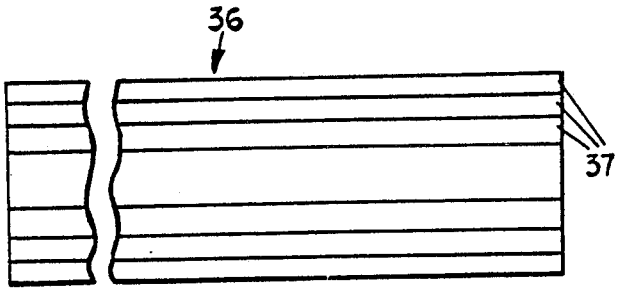
FIG. 3 is a fragmented plan view of a reflecting means of the sleeve.

The quality and color of reflected light can be varied by employing substrates of different color and light reflecting characteristics. The user can vary lighting characteristics by removing the element 26 and the tube 12 circumscribing the same from their mounting to the fixture 11 and replacing the substrate with one that has the desired qualities. Furthermore, the substrate 36 need not be of uniform light reflecting capacity. As shown in FIG. 3, the substrate 36 can comprise several zones 37, each zone having a different light reflecting capability. For example, the zones can vary with respect to color or transparency. Further, the zones 37 may be arranged to provide a gradation of light reflecting ability. Rotation of the substrate 36 with zones 37 through rotation of the tube 12 would further enable the user to vary the quality and character of reflected light.

Figure 4:
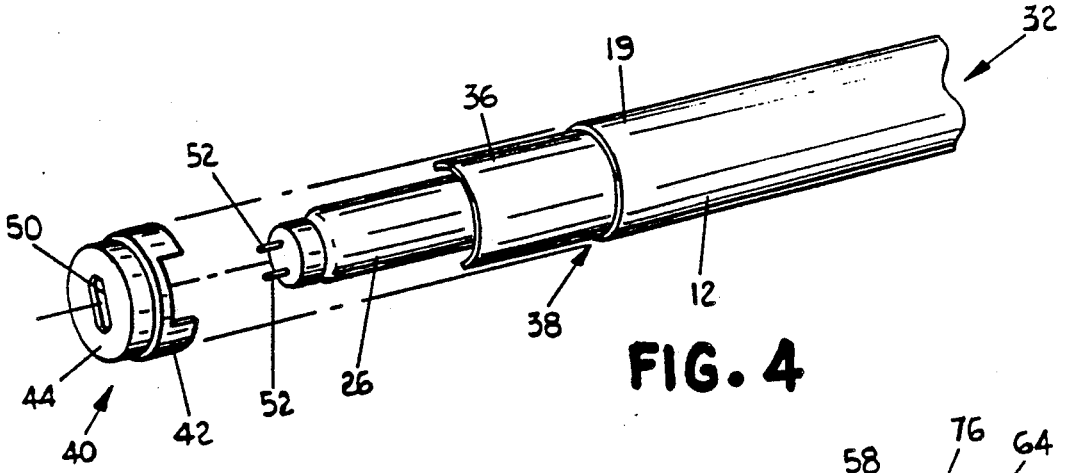
FIG. 4 is an exploded fragmented view of the sleeve telescopically receiving the fluorescent light element.

As shown in FIG. 4, the sleeve 10 further includes means for covering open ends 38 of the tube 12 to retain glass fragments in the tube in the event that the element 26 breaks. The cover means comprises a pair of molded plastic end caps 40, each comprising a rim 42 and an end face 44. The caps slidably and rotatably mount to the tube 12, with the face 44 covering the tube open ends and the rim slidably engaging the wall 19 of the tube 12. Each end face 44 is provided with an aperture 50 through which protrude electrical prongs 52 of the fluorescent element 26. The tube 12 is rotatable relative to the element and the caps 40.

In assembly, the flanges 15, 15*a*, respectively associated with the longitudinal edge 14 and the lens 20, are manually engaged to create the seam 18. Alternatively, the longitudinal edges 14, 16 of the tube 12 are manually placed in the overlapped configuration to create the seam 18*a*, frictional forces of adhesion retaining the edges in their overlapped configuration. The fluorescent element 26 is then positioned within the hollow interior 32 of the tube. The desired reflective substrate 36 is subsequently placed within the void 34 between the tube 12 and the element 26, the substrate clinging to the tube. The end caps 40 are then mounted on the open ends 38 of the tube, with the prongs 52 of the element 26 protruding through the apertures 50 of the caps. The sleeve 10 is then mounted on the fixture 11, with the prongs 52 of the element being received by the electrical receptacles (not shown) of the fixture. As mounted, the sleeve 12 is freely rotatable about the longitudinal axis of element 26, the reflective substrated being adapted to rotate along with rotation of the tube. Thus, by rotating sleeve 12, the user can independently control the direction of emitted light.

FIG. 5 discloses an alternate embodiment of the sleeve 10, wherein reflective substrate 36' adheres to the exterior surface 48 of tube 12. In this embodiment, the substrate 36' comprises a sheet of reflective tape.

Figure 6:
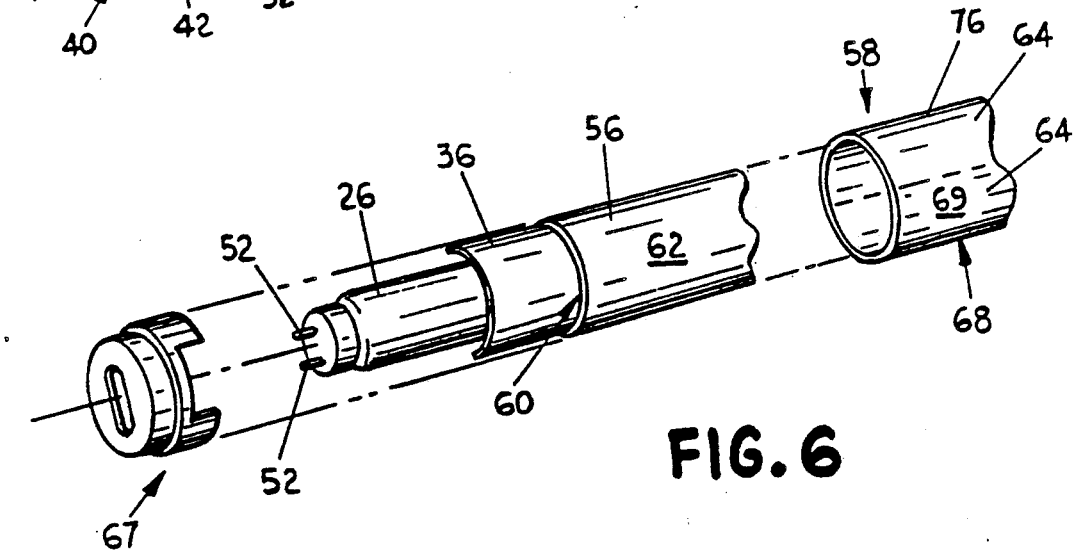
FIG. 6 is an exploded fragmented view of a further embodiment of the sleeve telescopically receiving the fluorescent light element.
Figure 7:
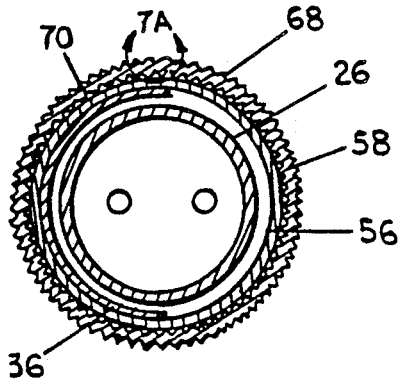
FIG. 7 is a cross sectional view of the embodiment illustrated in FIG. 6.

FIGS. 6 and 7 disclose a third embodiment comprising a fluorescent element 26 within a pair of first and second tubes 56, 58, the second tube having a greater cross-sectional area than that of and telescopically receiving the first tube. The fluorescent element 26 is telescopically received within the first tube 56 in a manner identical to that shown in connection with the embodiment of FIGS. 1-4. The first tube 56 is formed without the lens 20. A substrate 36 can be mounted to an interior surface 60 or an exterior surface 62 of the first tube as described above. Open ends of the first tube are covered by end caps 67 identical with caps 40 described above.

Figure 7A:
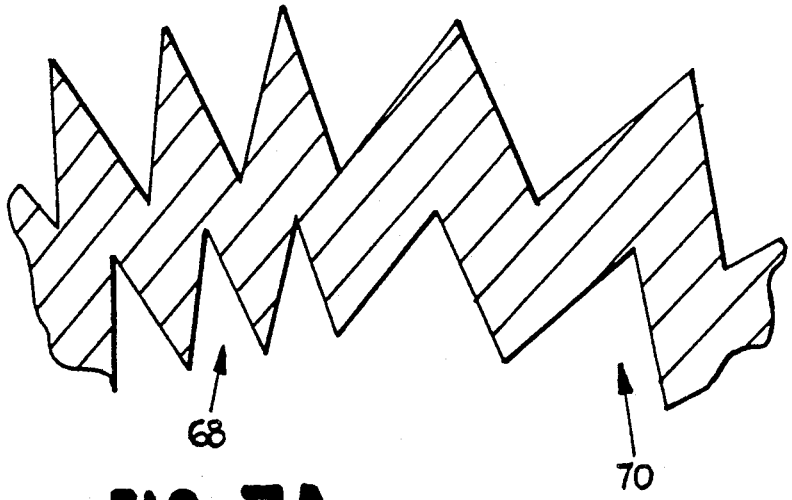
FIG. 7A is an enlarged fragmented view of a portion of FIG. 7.

The first tube 56 and the element 26 are telescopically received by the the second tube 58. The tube 58 is formed of the same material as the tube 56 and has a light diffusing means providing for alternative light diffusing capability. To this end, for example, the second tube 58 has formed integral with two longitudinally extending sections 64 of wall 69 of the tube 58 first and second lens 68, 70 shown conceptually in FIG. 6 in dotted lines. The lenses 68, 70, like lens 20, are of sawtooth configuration, when the tube 58 is viewed in cross-section. As best shown in FIG. 7A, the lenses 68, 70 comprise respective fields of prisms differing in geometry to provide the lenses with differing light diffusing and reflecting properties. In this manner, the quality of light reflected from the substrate 36 within the first tube 56 can be altered by merely manually rotating the second tube 58 relative to the first tube 56 such that either of lenses 68, 70 desired is positioned substantially opposite the substrate. Thereafter, the first tube 56 can be manually rotated relative to the second tube 56 to adjust light intensity. To facilitate convenient manual adjustment of the first tube 56 relative to the second tube 58, the same has a length less than that of the first tube, providing a portion of the ends of the first tube exposed for manual manipulation.

Although the second tube 58 has been described in connection with two lenses 68, 70, it will be appreciated that the tube can have formed integral therewith additional fields of lenses on an additional number of longitudinal sections of the tube to provide enhanced versatility in the sleeve's light diffusing capability.

While the invention has been described in connection with preferred embodiments, it will be understood that the invention is not limited to the disclosed embodiments. To the contrary, reasonable variations, alternatives and modifications are possible within the spirit and scope of the invention as defined in the appended claims.

I claim:

1. In a sleeve adapted to be mounted on a light element to protect said element and intercept light emitted therefrom, said sleeve comprising a tube adapted to telescopically receive said element and means carried by said tube for reflecting light emitted from said element, the improvement wherein:

said tube is adapted to be mounted on and supported by said element for free rotation relative thereto to permit adjustment of said reflecting means about said element thereby to control the direction of reflected light, and further comprising means carried by said tube opposite said reflecting means for diffusing light reflected therefrom.

2. A sleeve according to claim 1, wherein said tube has inner and outer surfaces and said reflecting means comprises a flexible reflective sheet positioned within said tube and mounted on said inner surface thereof.

3. A sleeve according to claim 6, wherein said reflective sheet is formed of aluminum covered paper.

4. A sleeve according to claim 1, wherein said tube has inner and outer surfaces and said reflecting means comprises a flexible sheet mounted on said outer surface of said tube.

5. A sleeve according to claim 1, wherein said diffusing means comprises a field of prisms formed on and extending along a longitudinally extending portion of said tube.

6. A sleeve according to claim 1, wherein said tube further comprises opposite open ends and means for covering said open ends to enclose said element within said tube.

7. A sleeve according to claim 6, wherein said element further comprises electrical prongs at opposite ends thereof, said covering means comprising a pair of end caps rotatably mounted on said open opposite ends, each cap comprising a rim removably and slidably engaging the respective tube open end and a face supported by said rim and having an opening therein for receiving the respective electrical prongs therethrough, said rim being formed to permit rotation of said tube relative to said element.

8. A sleeve according to claim 7, wherein said end caps are formed from molded plastic.

9. A sleeve according to claim 1, and, wherein said light diffusing means a second tube having a greater cross-sectional area than that of and telescopically receiving said first-mentioned tube for rotation relative thereto, said second tube further having means for providing alternative light diffusing properties;

whereby said tubes can be independently rotated relative to said element to adjust the direction of light emitted therefrom and the quality of light reflected from said reflecting means.

10. A sleeve according to claim 9, wherein said second tube has a length less than that of said first-mentioned tube to facilitate independent rotation of said tubes about said element.

11. A sleeve according to claim 9, wherein said light diffusing means comprises at least two fields of prisms extending along at least two longitudinally extending portions of said second tube, the prisms of one of said two fields differing in geometry and light diffusing properties from the prisms of the other of said two fields;

whereby said second tube can be rotated independently of said first-mentioned tube to position a selected one of said fields of prisms opposite said reflecting means to alter the character of reflected light.

12. A sleeve according to claim 11, wherein said first-mentioned tube further comprises opposite open ends and means for covering said open ends to substantially enclose said element within said firstmentioned tube.

13. A sleeve according to claim 12, wherein said element further comprises electrical prongs at opposite ends thereof, said covering means comprising a pair of end caps rotatably mounted on said ends of said first-mentioned tube, each cap comprising a rim removably and slidably engaging the respective end of said first-mentioned tube and a face supported by said rim and having an opening therein adapted to receive the respective electrical prongs therethrough, said rim being formed to permit rotation of said first-mentioned tube relative to said element.

14. A sleeve according to claim 11, wherein said first-mentioned tube has inner and outer surfaces and said reflecting means comprises a flexible reflective sheet positioned within said tube and mounted on said inner surface thereof.

15. A sleeve according to claim 14, wherein said reflective sheet is formed of aluminum covered paper.

16. In a sleeve adapted to be mounted on a light element to protect said element and intercept light emitted therefrom, said sleeve comprising a tube adapted to telescopically receive said element and means carried by said tube for reflecting light emitted from said element, the improvement wherein:

said tube is adapted to be mounted on and supported by said element for free rotation relative thereto to permit adjustment of said reflecting means about said element thereby to control the direction of reflected light, and further comprising means carried by said tube opposite said reflecting means for diffusing light reflected therefrom; and said tube is flexible and is split along a longitudinal axis of said tube to form first and second longitudinal edges thereof so that said tube can be stored in a relatively flat configuration.

17. In a sleeve adapted to be mounted on a light element to protect said element and intercept light emitted therefrom, said sleeve comprising:

a tube adapted to telescopically receive said element and means carried by said tube for reflecting light emitted from said element;

said tube adapted to be mounted on and supported by said element for free rotation relative thereto to permit adjustment of said reflecting means about said element thereby to control the direction of reflected light;

said tube being flexible and split along a longitudinal axis of said tube to form first and second longitudinal edges thereof so that said tube can be stored in a relatively flat configuration; and locking means for removably setting said first and second longitudinal edges in locking engagement so as to maintain said tube in a cylindrical configuration.

18. A sleeve according to claim 17, wherein said locking means comprises said second longitudinal edge, said second longitudinal edge being configured to form a depression in said tube, and a flange formed integral with and extending outwardly relative to said first longitudinal edge, said flange being adapted to be set in engagement with said second longitudinal edge within said depression to removably set said first and second longitudinal edges in locking engagement so as to maintain said cylindrical configuration of said tube.

19. In a sleeve adapted to be mounted on a light element to protect said element and intercept light emitted therefrom, said sleeve comprising:

a tube adapted to telescopically receive said element and a reflective on said tube for reflecting light emitted from said element;

said tube adapted to be mounted on and supported by said element for free rotation relative thereto to permit adjustment of said reflective sheet about said element thereby to control the direction of reflected light;

said reflective sheet comprising a plurality of longitudinally extending zones having different light reflecting characteristics so that rotation of said reflective sheet through rotation of said tube permits alteration of character of reflected light.

* * * * *